United States Patent [19]

Hannen

[11] Patent Number: 4,496,310

[45] Date of Patent: Jan. 29, 1985

[54] BURNER FOR PRODUCING A FLOW OF HOT GAS IN PARTICULAR FOR SHRINKING A PLASTIC FOIL

[75] Inventor: Rainer W. Hannen, Goch, Fed. Rep. of Germany

[73] Assignee: MSK-Verpackungs-Systeme GmbH, Kleve, Fed. Rep. of Germany

[21] Appl. No.: 513,670

[22] Filed: Jul. 14, 1983

[30] Foreign Application Priority Data

Jul. 16, 1982 [DE] Fed. Rep. of Germany ..... 3226615

[51] Int. Cl.[3] ..... F23D 13/24

[52] U.S. Cl. ..... 431/350; 431/353

[58] Field of Search ..... 431/158, 350, 353; 432/222

[56] References Cited

U.S. PATENT DOCUMENTS 3,494,711 2/1970 Spielman ..... 432/222

3,779,694 12/1973 Zagoroff ..... 431/158

4,067,686 1/1978 Karpisek ..... 431/352

*Primary Examiner*—Carroll B. Dority, Jr.

*Attorney, Agent, or Firm*—Shlesinger Arkwright Garvey & Fado

[57] ABSTRACT

The invention concerns a burner for producing a jet of hot gases, in particular to shrink plastic foils, with a pressure distribution chamber of a fan-like contour joined to a mixture feed means and merging at its wide end into a combustion chamber of an elongated cross-section, a flame holder being mounted in the transition zone between the pressure-distribution and the combustion chambers. In order that such a burner evince more reliable and constant properties while being of a simple design, the flame holder shall be a bar of shaped section extending across the entire width of the pressure-distribution and combustion chambers and together with the adjacent walls shall form passageway-gaps for the combustion gases.

17 Claims, 3 Drawing Figures

BURNER FOR PRODUCING A FLOW OF HOT GAS IN PARTICULAR FOR SHRINKING A PLASTIC FOIL

BACKGROUND OF THE INVENTION

The invention concerns a burner for producing a flow of hot gas, in particular to shrink a plastic foil, with a pressure-distributing chamber of a fan-shaped contour connected to mixture feed-means and merging at its wide end into a combustion chamber, a flame-holder being mounted in the transition zone between the pressure-distribution and combustion chambers.

Such burners are needed to shrink plastics, for instance in the form of wraps which are drawn on a stack of goods located on a pallet. The shrinkage can be carried out using manual implements, but also with automatic equipment which is stationary. It is important that a uniform, flame-free flow of hot gas be produced when shrinking. Especially where manual implements are used, the widest possible exhaust of the burner exhaust gases is desired. Accordingly the combustion chamber and its discharge are designed with an elongated cross-section.

A burner of the initially cited species is known (German patent application No. P 32 15 608.0). The flame-holder in this burner is formed by a plurality of bars parallel to one another and extending above the height of the rectangular cross-section at the beginning of the combustion chamber. Because such a flame-holder constitutes a substantial flow impedance, it also effects simultaneously a distribution of the gases flowing from the pressure distributor into the combustion chamber. The assumption in this case is that the individual bars of the flame-holder are positioned at relatively precise spacings from each other. However such an accurate arrangement can be achieved only with difficulties in actual manufacture. Changes in the pressure distribution in the combustion chamber and hence irregularities in the outflowing hot gas however are incurred already for rather small deviations.

The object of the invention is to so improve a burner of the initially described species that it evinces reliable and uniform properties with simple design.

This problem is solved in that the flame holder is a bar of shaped section which extends over the entire width of the pressure distribution chamber and combustion chamber and which together with the adjoining walls forms passageway-gaps for the combustion gases.

In this burner the flame holder is reduced to a single component which even in manufacture can be very precisely positioned using simple means. Even when making large numbers, reliable and constant properties of the burners can be realized. The bar-shaped flame holder equally divides the flow of gas entering the combustion chamber. The partial flows entering the combustion chamber through the passageway-gaps are drawn by the effect of the dead water formed behind the shaped-section bar into the center of the combustion chamber and therefore less stress the combustion chamber walls when being burned.

Particularly advantageous conditions arise when the flame holder is a tube producing to the side of the flow a pronounced dead-water area which not only causes the desired guidance of the partial flows toward the center of the combustion chamber, but also generates intense turbulence of the combustion gases. This is especially the case when the passageway-gaps are of the same dimensions.

A preferred embodiment of the invention is characterized in that the essentially plane walls of the pressure-distribution and combustion chambers join in a kink in the transition zone and in that the tube is mounted symmetrically to the kink. In such a case passageway-gaps with Venturi-like cross-sections are produced between the outsides of the tube and the adjoining walls.

To make possible complete combustion of the combustion gases before they are discharged from the combustion chamber, the legth of the combustion chamber, seen in the direction of flow of the combustion gases, should be at least three times the height of the combustion chamber which is constant over its length.

To improve the pressure distribution across the width of the combustion chamber, the pressure distribution chamber may be additionally provided with installations to guide and distribute the combustion gases. These installations in particular should be so designed and arranged that always the same pressure conditions prevail across the width of the combustion chamber and that always the same rates of combustion gases enter the combustion chamber.

The installations can be made in particular of sheetmetal or plate essentially extending across the pressure distribution chamber and forming together with the walls of the pressure distribution chamber a passageway-gap. In addition the sheetmetal or plate can also be perforated.

An illustrative embodiment of the invention shown in the drawing is discussed below.

Figure 1:
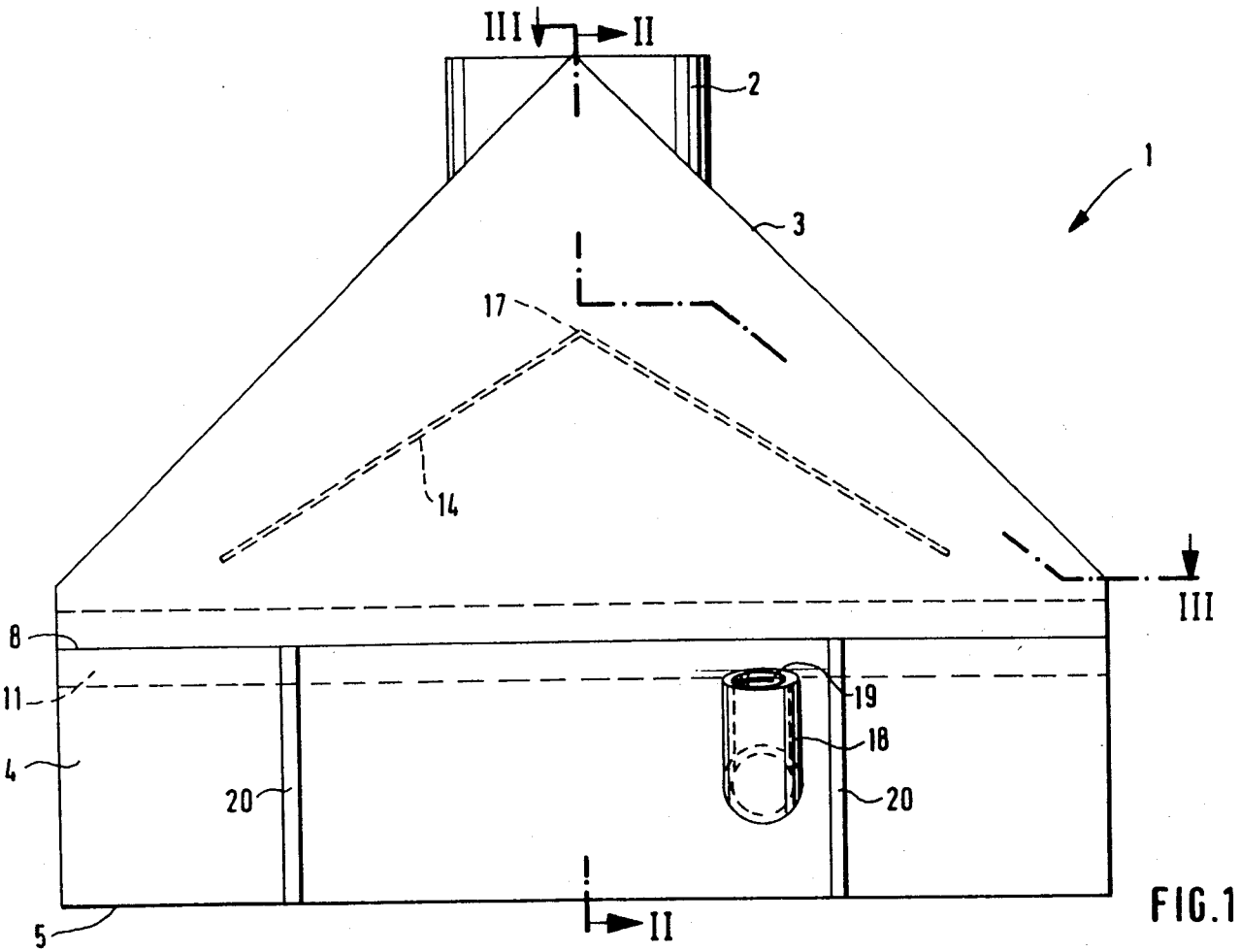
FIG. 1 is a topview of a burner.

The burner 1 shown in the drawing produces a flow of hot gas made from combustion gases. It is used in shrinking a plastic foil, for instance of shrink-wraps drawn onto a pallet stack.

In its basic design, the burner consists of a mixture feed-tube 2 joining a pressure-distributing chamber 3 of a fan-shaped contour (FIG. 1). The pressure distributing chamber 3 merges into a combustion chamber 4 with a discharge 5. In the transition zone between the pressure distribution chamber 3 and the combustion chamber 4 both the pressure distribution and the combustion chambers 3 and 4 respectively have an elongated rectangular cross-section onto which converge the side walls 6,7 of the pressure distribution chamber 3. These side walls 6,7 of the pressure distribution chamber 3 merge by a kink 8 into the adjoining side walls 9,10 of the combustion chamber 4. For instance the length of the combustion chamber is at least 45 mm and its height 15 mm. The width of the combustion chamber and hence also the width of the pressure distribution chamber in the transition zone (kink 8) is 180 mm in the illustrative embodiment.

A tube 11 is the flame holder and is arranged in the transition zone between the pressure distribution chamber 3 and the combustion chamber 4, extending across the entire width and, as shown, mounted symmetrically with respect to the kink 8, and furthermore, together with the neighboring sidewalls 6,7 and 9,10 forming passageway gaps 12, 13 of constant widths for the combustion gases.

Figure 2:
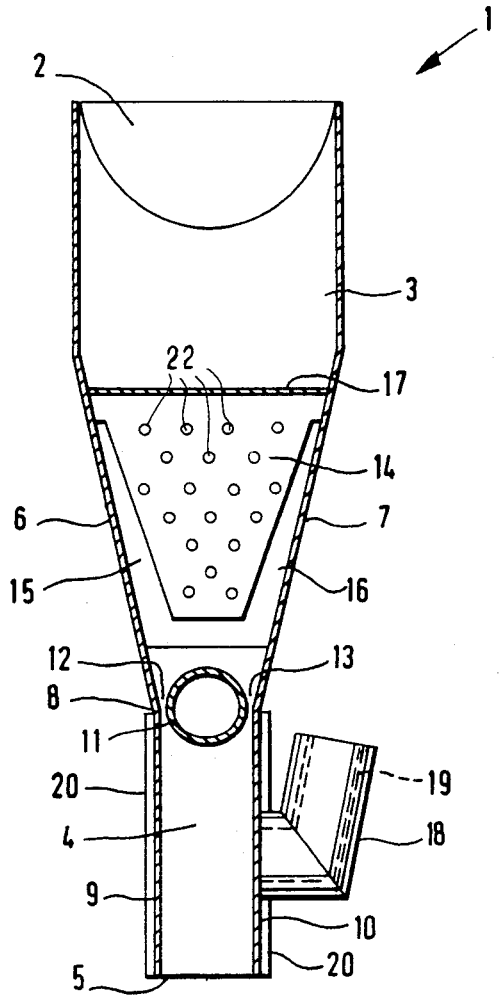
FIG. 2 is a section in the direction II—II of the object of FIG. 1.
Figure 3:
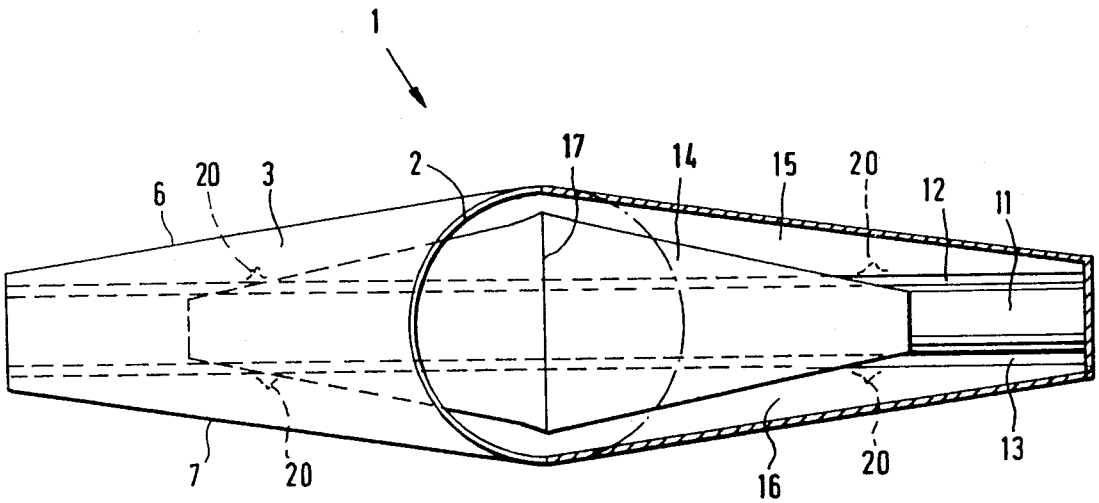
FIG. 3 is an elevation with a partial section along the direction III—III of FIG. 1.

To improve the pressure distribution of the combustion gases upon entry into the combustion chamber 4, the pressure distribution chamber 3 is provided with installations which in the embodiment shown are formed by a plate or sheetmetal 14 essentially extending transversely through the pressure distribution chamber 3 and together with the side walls 6,7 of the pressure distribution chamber 3 forming passageway gaps 15 and 16. The sheetmetal 14 is angled at the middle, whereby two legs which in the illustrative embodiment shown subtend an angle of 117° to each other are produced which are fastened in the area of their common folding edge 17 to the side walls 6,7 of the pressure distribution chamber 3. As shown, the legs extend toward the combustion chamber and provide that the combustion gases flowing out of the mixture feed tube are so distributed that they enter the combustion chamber 4 at the same pressure and at the same rate. As best shown in FIG. 2, sheetmetal 14 may include a plurality of perforations 22 therethrough.

The FIGS. 1 and 2 furthermore show that a connector 18 with an inside thread 19 can also be mounted on the side wall 10 of the combustion chamber 4.

Moreover cover laps (20) are provided at the long side walls 9,10 of the combustion chamber 4 and extend in the direction of the outflowing gases. These cover laps 20 also can be formed by angled and mutually welded ends of neighboring wall segments. In this manner the burner geometry remains constant even in the presence of high thermal stresses.

I claim:

1. A burner for producing a flow of hot gas, in particular for shrinking a plastic foil, comprising:

(a) Mixture inlet means;

(b) a pressure distribution chamber connected to and in flow communication with said inlet means;

(c) a transition section connected to and in flow communication with said pressure distribution chamber;

(d) a combustion chamber connected to and in flow communication with said transition section and said combustion chamber having a discharge opening;

(e) said combustion chamber have an elongated inlet of substantial length in cross section;

(f) said transition section being tapered and having substantial planar side walls converging on said inlet of said combustion chamber;

(g) a flame holder positioned substantially in said transition section generally in the area of connection of said transition section with said combustion chamber and said flame holder having a length substantially equal to said inlet length and thereby substantially spanning said combustion chamber inlet; and, (h) said flame holder is a substantially cylindrical member positioned in close proximity with said side walls and therewith forming passageway gaps adapted for accelerating flow of a mixture to said combustion chamber.

2. The burner as defined in claim 1, wherein:

(a) said flame holder is a tube of constant radius.

3. The burner as defined in claim 1, wherein:

(a) said flame holder positioned equidistant said side walls whereby each of said passageway gaps has an equal width opening permitting flow therethrough of a mixture.

4. The burner as defined in claim 1, wherein:

(a) each of said passageway gaps has a shape in the flow direction defining a venturi.

5. The burner as defined in claim 1, wherein:

(a) said combustion chamber having a length in the flow direction and a height; and (b) said length is equal to at least three times said height.

6. The burner as defined in claim 5, wherein:

(a) said height is constant over said length.

7. The burner as defined in claim 1, wherein:

(a) a plurality of installations mounted in said pressure distribution chamber for guiding and distributing said mixture during flow therethrough.

8. The burner as defined in claim 7, wherein:

(a) said installations extend generally transversely through said pressure distribution chamber; and, (b) said installations include edges spaced from side walls of said pressure distribution chamber and therewith forming passageway gaps permitting flow of a mixture therethrough.

9. The burner as defined in claim 8, wherein:

(a) said installations each includes a plate.

10. The burner as defined in claim 9, wherein:

(a) each of said plates having a plurality of perforations therethrough.

11. The burner as defined in claim 1, wherein:

(a) said combustion chamber includes long side walls; and, (b) said long side walls include cover laps extending in the flow direction.

12. The burner as defined in claim 11, wherein:

(a) each of said long side walls includes an angled portion; and, (b) adjacent ones of said angled portions are secured together for forming said cover laps.

13. The burner as defined in claim 9, wherein:

(a) said plate being bent and thereby providing two angularly disposed legs.

14. The burner as defined in claim 13, wherein:

(a) said legs subtend an angle of 117°.

15. The burner as defined in claim 13, wherein:

(a) said plate being bent at generally the midpoint thereof whereby said legs have equal lengths;

(b) a common folding edge defined by said plate and from which said legs extend; and (c) said common folding edge have a portion thereof secured to said side walls of said pressure distribution chamber.

16. The burner as defined in claim 13, wherein:

(a) said legs extend toward said combustion chamber and each of said legs includes a portion thereof disposed within said transition section.

17. The burner as defined in claim 1, wherein:

(a) a portion of said flame holder extends into said transition section and another portion of said flame holder extends into said combustion chamber.

* * * * *